United States Patent [19]

Frech

[11] Patent Number: 4,555,850

[45] Date of Patent: Dec. 3, 1985

[54] HAND PLANE, IN PARTICULAR A HAND PLANE MACHINE DESIGNED AS AN ELECTRIC HAND TOOL MACHINE

[75] Inventor: Alfred Frech, Stuttgart, Fed. Rep. of Germany

[73] Assignee: Robert Bosch GmbH, Stuttgart, Del.X

[21] Appl. No.: 547,053

[22] Filed: Oct. 28, 1983

[30] Foreign Application Priority Data

Jan. 12, 1983 [DE] Fed. Rep. of Germany ..... 3300753

[51] Int. Cl.[4] ..... B27G 17/02

[52] U.S. Cl. ..... 30/490

[58] Field of Search ..... 145/15

[56] References Cited

U.S. PATENT DOCUMENTS

| | | | |
|---|---|---|---|
| 20,493 | 6/1858 | Kendall | 145/15 |
| 102,406 | 4/1870 | Katz | 145/15 |
| 502,906 | 8/1893 | Hardt | 145/15 |
| 1,432,860 | 10/1922 | Hoy et al. | 145/15 |

FOREIGN PATENT DOCUMENTS

| | | | |
|---|---|---|---|
| 52061 | 2/1914 | Austria | 145/15 |
| 252181 | 9/1948 | Switzerland | 145/15 |

*Primary Examiner*—Frederick R. Schmidt
*Assistant Examiner*—J. T. Zatarga
*Attorney, Agent, or Firm*—Michael J. Striker

[57] ABSTRACT

A hand plane, especially a hand plane machine, is provided with an adjusting and indicating arrangement for the planing depth. A wedge which is located before the tool element of the hand plane machine is adjustably fixed to an inclined base surface of the housing and constitutes the contact surface of the hand plane machine. A part of the wedge projects beyond the forward edge of the housing and is provided at its upper side with a scale. By means of the housing edge, the displacment of the wedge and consequently the adjustment of the planing depth can be read from the scale. The hand plane is of simple structure and good stability with respect to the adjustment, wherein the wedge can be fastened to the housing for example through screwing.

11 Claims, 6 Drawing Figures

HAND PLANE, IN PARTICULAR A HAND PLANE MACHINE DESIGNED AS AN ELECTRIC HAND TOOL MACHINE

BACKGROUND OF THE INVENTION

The invention relates to a hand plane, in particular to a hand plane machine designed as an electric hand machine tool. In general, the hand plane is provided with an arrangement for adjusting the planing depth by adjusting the contact surface lying in front of the tool element of the hand plane machine, and which arrangement allows the reading of the adjusted planing depth. Such hand planes are already known, for example from the European patent application No. 0048304 or from German Offenlegungsschrift No. 3,025,797. In the DE-OS No. 3,025,797, the adjusting arrangement includes a rotatable adjusting handle which is connected to the tool element via an adjusting spindle and simultaneously has a curved body whose curved path surrounds helically or screw-shaped the rotational axis over an angle of more than 360°. The adjustment arrangement further includes a curve sensor which is connected to a movable indicator which together with a further indicator provides the adjustment of the tool element.

The adjustment arrangements in both applications are rather complicated and cumbersome when being sufficiently stable and readable in a sufficient manner. Upon rotatable adjusting handles which have an adjusting range below 360°, a steep thread is necessary for providing exact readability of the adjusted planing depth. This has the disadvantage that an increased force is necessary for adjusting and, nevertheless, the adjustment is less steady due to the decreasing automatic locking of the steep thread. Rotatable adjusting handles having an adjusting range over 360° are more stable, requiring however an increased provision of indicating means in order to provide an accurate indication. Finally, the effective limitation of the planing depth by a stop member requires additional measures.

SUMMARY OF THE INVENTION

It is a general object to avoid the prior-art disadvantages.

In particular, it is an object of the present invention to provide a hand plane which allows the adjustment of the planing depth in a simple manner.

A concomitant object of the present invention is to provide a hand plane in which the adjusting arrangement is stable, reliable in operation and inexpensive nevertheless.

In keeping with these objects and with others which will become apparent hereinafter, one feature of the present invention resides, briefly stated, in a hand plane comprising a housing having an inclined forward portion, a tool element fixed to the housing, and means for adjusting the planing depth and including a wedge-shaped element movably fixed to the forward portion of the housing in direction of displacement and having a base surface constituting the contact surface of the hand plane, and means for fastening the wedge-shaped element in each position thereof with respect to the housing for adjusting the planing depth of the hand plane.

Preferably, the wedge-shaped element has a front portion which extends beyond the forward portion of the housing and accommodates a scale so that in cooperation with the forward edge of the forward portion of the housing, the planing depth can be easily read. The hand plane according to the present invention has the advantage that its structure is extremely simple and nevertheless provides a high stability. Through the provision of a wedge-shaped element arranged before the tool element of the hand plane machine, which wedge-shaped element projects beyond the forward edge of the housing, a secure adjustment and stability of the adjusted planing depth is guaranteed.

The adjusted planing depth is directly readable without any additional parts from the part of the machine which is adjusted for changing the planing depth in case the upper surface of the wedge-shaped element is provided with a scale.

In a preferred embodiment of the present invention, the forward portion of the housing is provided with at least one guide groove and the wedge-shaped element is provided with at least one guide rail engaging with the guide groove so as to provide the wedge-shaped element with a good guidance during the adjustment thereof.

According to another feature of the present invention, the wedge-shaped element includes a plurality of locking teeth arranged on the surface opposite to the base surface wherein the adjusting means further include a web engageable with a respective one of the locking teeth so as to allow adjusting of the planing depth. Preferably, a spring is provided which tends to continuously maintain the engagement of the web with a respective locking tooth by pulling the wedge-shaped element into this position.

The novel features which are considered characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS

Figure 1:
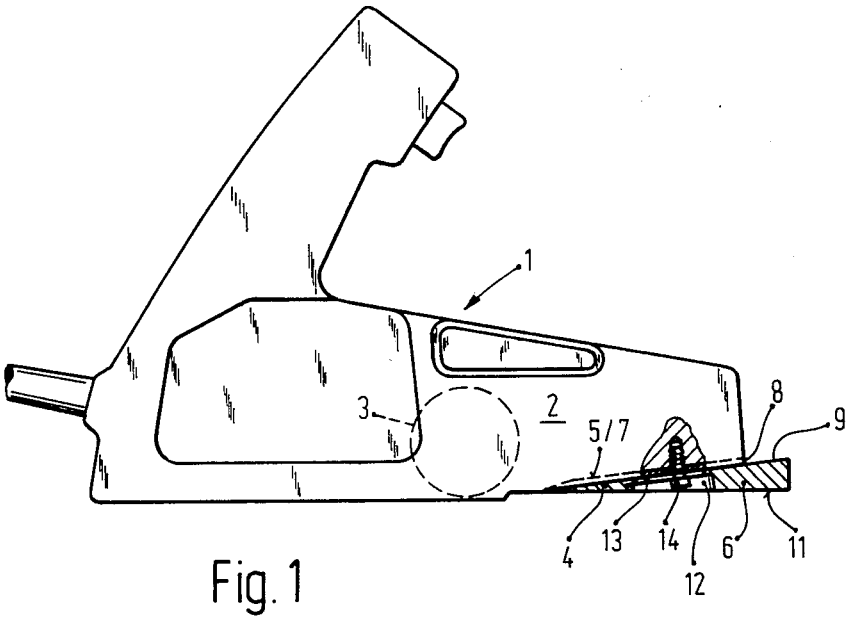
FIG. 1 is a side view of a first embodiment of a hand plane machine provided with an adjustment arrangement according to the invention.
Figure 2:
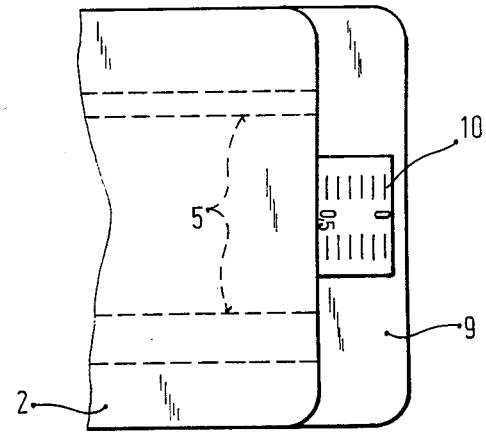
FIG. 2 is a partly top view of FIG. 1.

Referring firstly to FIGS. 1 and 2, which show a first embodiment of a hand plane machine 1, reference numeral 2 has been used to identify a housing which is provided with an inclined forward portion 4 following a tool element 3. Arranged within the forward portion 4 of the housing 2 are two guide grooves 5 extending in longitudinal direction of the housing 2. A wedge 6 is attached to the forward portion 4 and is provided with guide rails 7 which are in engagement with the guide groove 5.

As can be seen especially from FIG. 1, the wedge 6 is provided with a front portion 9 which extends beyond the forward edge 8 of the housing 2. The front portion 9 has an upper surface provided with a scale 10, which may be glued on the surface or be pressed in, cast or engraved into the front portion 9. The base surface of the wedge 6 constitutes the contact surface 11 of the hand plane.

For allowing the adjustment of the wedge 6 with respect to the housing 2, the wedge 6 is provided with an indentation 12 which cooperates with an oblong hole 13. The indentation 12 receives the head of a screw 14 provided with a hexagonal recess. The screw 14 projects through the oblong hole 13 and is screwed in a thread provided in the housing 2.

For adjusting a certain planing depth, the screw 14 is loosened and the wedge 6 is slid as long as the desired planing depth can be read on the scale 10 by means of the forward edge 8. Then, the screw 14 is tightened and the adjusted planing depth is continuously maintained.

In the embodiment according to FIG. 3, there is shown a hand plane machine 15 having a housing 16 which is provided with an inclined forward portion or contact surface 17 at the same location as illustrated in connection with the housing 2 of the first embodiment. Connected to the forward portion 17 is a wedge 18 which is arranged at its upper surface with a scale 19. The wedge 18 is provided along a portion thereof with a plurality of locking teeth 20 and with a web 21 which serves as a handle. Furthermore, as can be seen from FIG. 3, next to the web 21, an eyelet 22 is arranged on the upper surface of the wedge 18, to which the one end of a tension spring 23 is attached. The other end of the tension spring 23 is fixed to an eyelet 24 at the inner surface of the upper wall of the housing 16. The upper housing wall also has an oblong hole 25 through which one end of the web 21 projects towards the outside. A further web 26 is provided within the housing 16 and includes an arresting edge engageable with one of the locking teeth 20. The calibration of the locking teeth 20 is adjusted to the calibration of the scale 19. Both calibrations provide a corresponding value in millimeters for the altering position of a contact surface 27 of the wedge 18, which position corresponds to the adjusted planing depth. The oblong hole 25 forms a longitudinal guidance for the web 21 which projects as handle beyond the housing 16. Consequently, further guiding means as the guide rails according to the embodiment of FIGS. 1 and 2 is not necesary for the wedge 18. The forward edge of the housing 16 is identified by reference numeral 28 and serves for reading of the scale 19.

For adjusting the planing depth, the web 21 is pressed into the housing 16 until the respective locking tooth is disengaged fromm the web 26. Then, the wedge 18 is displaced with the web 21 until the desired planing depth can be read by means of the edge 28 and the scale 19. Upon releasing of the web 21, the tension spring 23 pulls the associated locking tooth in engagement with the web 26. Consequently, the adjusted planing depth is secured.

Figure 3:
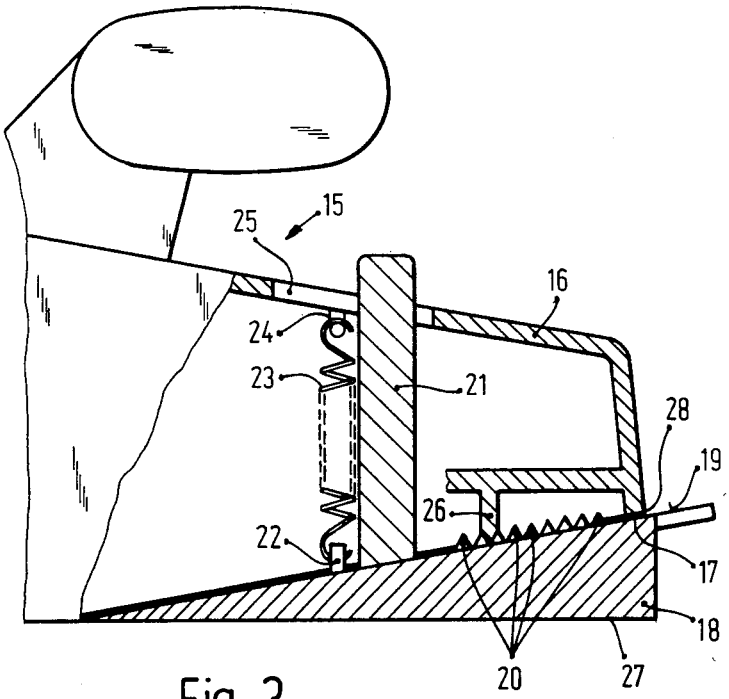
FIG. 3 is a side view of a second embodiment of the hand plane machine, illustrating a second adjusting arrangement according to the invention, partly cut away.
Figure 4:
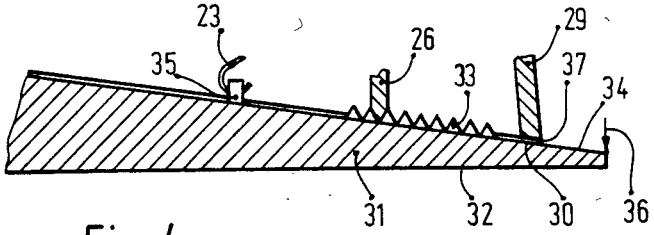
FIG. 4 is a side view of a third embodiment of the hand plane machine illustrating a modified adjusting arrangement of FIG. 3.

The embodiment according to FIG. 4 corresponds essentially to the embodiment according to FIG. 3. A housing 29 of the hand plane machine is provided with a contact surface 30 whose inclination is opposite to the inclination of the contact surface 17. Consequently, a wedge 31 is inclined in opposite direction and arranged on the contact surface 30. In correspondence with the embodiment of FIG. 3, the wedge 31 includes a base surface 32, a plurality of locking teeth 33, a scale 34 and an eyelet 35. Moreover, the embodiment according to FIG. 4 illustrates that the web 21 is provided in the embodiment of FIG. 3 can be omitted. In addition to the omission of the web 21, also the oblong hole 25 can be omitted in the upper wall of the housing 16.

For adjusting the planing depth, it is only necessary to press simply onto the wedge 31 in direction of arrow 36 so as to release the engagement between the respective locking tooth and the web 26. After displacing the wedge 31 into the position corresponding to the desired planing depth, the pressure is released and the tension spring 23 provides the engagement between the associated locking tooth 33 and the web 26. At the forward edge 37 of the housing 29, the adjusted planing depth can be read from the scale 34.

Figure 5:
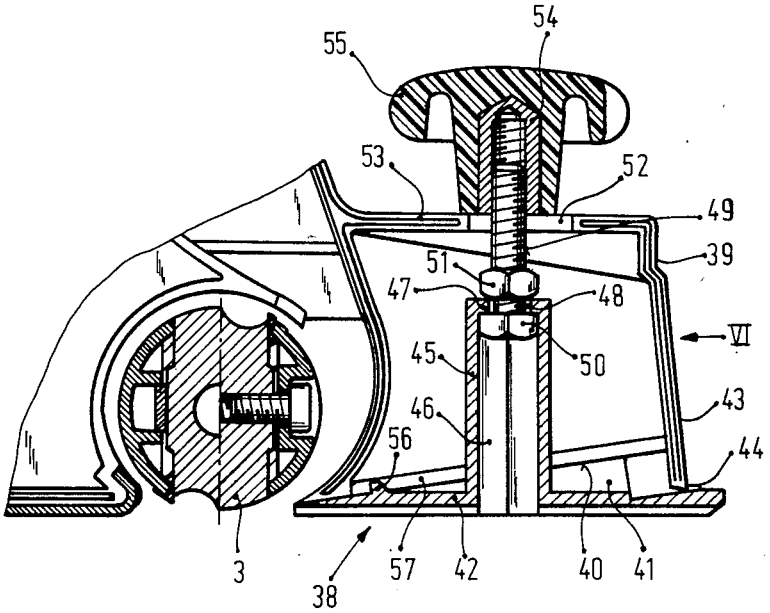
FIG. 5 is a partial view of a fourth embodiment of the hand plane machine illustrating a further adjusting arrangement according to the invention.
Figure 6:
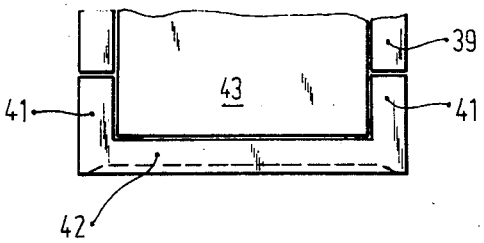
FIG. 6 is a view in direction of arrow 6 in FIG. 5.

The embodiment according to FIGS. 5 and 6 shows a forward portion of a hand plane machine 38 having a housing 39. An inclined surface 40 of the housing 39 serves as support for two side walls 41 of a wedge 42. A front wall 43 of the housing 39 engages between the side walls 41. The front wall 43 extends to a scale 44 provided on the wedge 42 which is provided with a tube-shaped extension 45 as can be seen from FIG. 5. The extension 45 is provided with a hexagonal recess 46. The extension 45 has a bottom 47 in which a throughhole 48 is formed. A screw 49 having a hexagonal head 50 is inserted into the extension 45 and the screw shaft which is provided with a thread projects through the throughhole 48 beyond the upper housing wall 53. The screw 49 is tightened to the bottom 47 of the extension 45 by a screwed nut 51. The upper housing wall 53 accommodates an oblong hole 52 through which a part of the screw shank projects, to which a tightening nut 54 is screwed. The tightening nut 54 is embedded in a handle 55. A nose 56 arranged on the wedge 52 is guided in a longitudinal groove 57 in the forward portion of the housing 39 forming the inclined surface 40.

For adjusting the planing depth, the tightening nut 54 is loosened by means of the handle 55. The wedge 52 is now displaceable and the planing depth can be adjusted. When the desired adjusting value is obtained, the tightening nut 54 is retightened by means of the handle 55. Consequently, the desired adjusting value is secured.

It will be understood that each of the elements described above, or two or more together, may also find a useful application in other types of hand planes differing from the types described above.

While the invention has been illustrated and described as embodied in a hand plane, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

I claim:

1. A hand plane, comprising: a housing having an inclined forward portion as considered in direction of displacement of the hand plane; a tool element fixed to the housing; means for adjusting the planing depth, including a wedge-shaped element having an upper surface with a plurality of locking teeth arranged thereon, the wedge-shaped element being adjustably fastened to the inclined forward portion of the housing and having a base surface opposite to the upper surface constituting a contact surface of the hand plane, the adjusting means futher including a web engageable with a respective one of the locking teeth so as to allow adjustment of the planing depth; and means for fixedly fastening the wedge-shaped element to the housing.

2. A hand plane as defined in claim 1, wherein the wedge-shaped element has a front portion extending forwardly beyond the forward portion of the housing.

3. A hand plane as defined in claim 2; and further comprising a scale arranged on the front portion of the wedge-shaped element for allowing a reading of the planing depth.

4. A hand plane as defined in claim 3, wherein the wedge-shaped element has a front portion on which the upper surface is located so as to be under the forward portion of the housing, the scale being arranged on the upper surface of the front portion.

5. A hand plane as defined in claim 1, wherein the forward portion of the housing is provided with at least one guide groove, the wedge-shaped element being provided with at least one guide rail engaging the guide groove so that the wedge-shaped element is displaceable relative to the housing.

6. A hand plane as defined in claim 1, wherein the housing includes an upper housing part provided with a recess, the fastening means including at least one spring having one end fixed to the wedge-shaped element and another end fixed to the upper housing part.

7. A hand plane as defined in claim 4, wherein the scale is glued to the upper surface of the front portion of the wedge-shaped element.

8. A hand plane as defined in claim 4, wherein the scale is pressed on the upper surface of the front portion of the wedge-shaped element.

9. A hand plane as defined in claim 4, wherein the scale is cast on the upper surface of the front portion of the wedge-shaped element.

10. A hand plane as defined in claim 4, wherein the scale is engraved on the upper surface of the front portion of the wedge-shaped element.

11. A hand plane as defined in claim 6; and further comprising a handle having one end attached to the wedge-shaped element and another end projecting through the recess so as to provide a guidance of the element relative to the housing.

* * * * *